United States Patent [19]

Banner

[11] 4,035,617

[45] July 12, 1977

[54] TIDE AND TIME CALCULATING DEVICE

[76] Inventor: Philip M. Banner, 28 Oxford Road, Massapequa, N.Y. 11758

[21] Appl. No.: 479,248

[22] Filed: June 13, 1974

Related U.S. Application Data

[63] Continuation-in-part of Ser. No. 243,001, April 11, 1972, Pat. No. 3,825,181.

[51] Int. Cl.[2] ..... G06C 3/00; G04B 19/26

[52] U.S. Cl. ..... 235/88 N; 58/3

[58] Field of Search ..... 58/3; 235/88, 85, 61 NV

[56] References Cited

U.S. PATENT DOCUMENTS

| | | | |
|---|---|---|---|
| 3,524,313 | 8/1970 | Wood | 58/3 |
| 3,703,804 | 11/1972 | Appelberg | 58/3 |
| 3,708,971 | 1/1973 | Wlodyka | 58/3 |
| 3,825,181 | 7/1974 | Banner | 235/88 |

*Primary Examiner*—Stephen J. Tomsky

[57] ABSTRACT

A time and tide calculating device for wrist watches clocks and calculators that register the tides and the time of the tides, comprising rotatable concentric tide and calendar discs placed adjacent to a clock face for indicative registration and cooperation with time telling devices, having various arrangements of said tide and calendar discs showing tide positions and the calendar date in registration with clock and watch faces that also include digital information on day, date and the AM or PM by the development of new clock works to rotate such information required for telling the date, the time, the AM or PM, the tide and a reference on said calendar disc responsive to showing the state of the tides in advance for the following days of a calendar.

6 Claims, 14 Drawing Figures

TIDE AND TIME CALCULATING DEVICE

This invention application is a continuation in part to my prior application Ser. No. 243,001 filed 04/11/1972 and now U.S. Pat. No. 3,825,181 issued date 07/23/1974.

BACKGROUND OF THE INVENTION

This invention pertains to tide and time calculating devices, presenting an improvement on my original patent application by the development of automatic and manual means to operate all parts of this invention in cooperation with standard and electronic clock and watch movements. Furthermore, this invention was developed in the interest of safety to navigators, fishermen, yachtsmen and shore dwellers everywhere who desire to know the tide and the time it will occur. Small craft and cabin cruisers using inland waters require to know the tides so that they may safely travel without the hazards of low water when it becomes treacherous to navigate. The field of art that this invention relates to concerns an improvement to clocks and watches for areas that have one or more tides that on clocks and watches would you find this relevant information further shown in the specifications, the drawings and the claims. This invention teaches the use of the tide and calendar discs that work in registration with a twelve or twenty-four hour clock face or digital electronic clock movements having the advantages of day, date, time, AM or PM indication in addition to a new tide coordinating disc, rotatably affixed to show the occurence of tides in at least one or more places valuable to those who seek information relative to tidal information in other areas they may be traveling to. The new art also includes the method of internal movement to facilitate the rotation of internal information discs that provide day, date and movement of the AM PM factor that are moved by existing watch and clock movements. The prior art includes tide information devices that incorporate complex expensive components to render this information, none of which have taken the actual clock face into consideration, as I have, in placing calendar markings in registration with a clock face, so that each approximately 50 minutes show lunar tides for that day or for as many days, weeks or months as the calendar disc shows. Another improvement shows the use of a seasonal tide evaluation disc that would allow of tidal adjustments manually in accordance with the various tides that differ throughout the year. Inexorably, since time has been noted historically those whose lives were regulated by the movement of the tides and by the flowing of the tidal streams have associated these events with the Moon, its rising and setting, its waxing and waning. Because the tides on the Grecian shores are very small and that their periodic movements are frequently obscured by the non-periodic changes in sea level arising from weather conditions, the ancient Greek philosophers had little first hand knowledge of the tides. Greek sailors had no experience with the regular tides on the Atlantic shores of Europe due to the blockade of the Strait of Gibraltar, maintained by the Carthaginians from 500 B.C. until their final defeat by the Romans. It was when the army of Alexander the Great reached the shores of the Arabian Sea in 325 B.C. that the Greeks experienced tides of any magnitude. It was about this period that Aristotle wrote "it is even said that the many ebbings and risings of the sea always come round the Moon and upon certain fixed times". By 1650 it was generally accepted that the tidal movements were connected with the Moon and was unexplicable until Sir Isac Newton discovered the laws of Universal Gravitation. He published his "Principia" in 1687 and in it, he showed that all known movements of the solar system could be concluded from the one assumption, that each particle of matter in that system acts as though it attracts every other particle with a force proportional to the square of the distance between them.

The explanation of the tides is relatively important to this invention because it shows an art of handling comparative tidal information and seasonal variables that are inseparably part of the invention. The Lunar Tide is the gravitational force, which tends to draw the Earth and the Moon towards one another, they are balanced by an equal and opposite centrifugal force caused by their monthly rotation about a common center of gravity. According to Newton's law, the gravitational pull exerted by the Moon on that part of the Earths surface nearest the Moon must be greater than the average exerted on the whole Earth. Naturally, the diametrically opposite part would be less and these differences in attraction are termed lunar tide generating forces. The centrifugal force, however, is the same on all particles of the Earth. Therefore, the difference in attraction is directed towards the Moon at that point on the Earth's surface nearest the Moon and away at the diametrically opposite point. Only the water on the Earth's surface is free to move and consequently tends to be drawn away from the vicinity of those meridians directly under and 180° from the Moon. The magnitude and time of lag of the response of the water to tide generating forces varies according to terrestrail conditions, such as the depth, shape and size of the sea in which the tidal area is located.

The Solar Tides are tide-generating forces that also arise from the differences in attraction of the Sun on parts of the Earth's surface, tending to cause low water on the meridians where Sunrise and Sunset occur and high water on the meridians directly under and 180° from the Sun. Owing to the great distances between the Earth and the Sun, solar tide-generating forces are less than half of those caused by the moon.

Other tides that are important to tidal analysis should also be taken in consideration, each proving the variables that make up tides. The spring Tides occur when the Sun and the Moon are in conjunction (New Moon) or in opposition (Full Moon) the two tide-generating forces are acting on the same meridians, so that the height and range of the tide will be greater than at other periods. These tides are called Springs. Neap Tides occur when the Moon and the Sun are in quadrature, the two tide-generating forces are acting at right angles to each other, producing a tide which has a higher low water than average an a range which is smaller than at other periods. These small tides are known as Neaps. Perigee Tides occur because the Moon's orbit is elliptical and so its distance from the Earth varies throughout the month. When it is nearest to the Earth the Moon is said to be in Perigee, and when furthest away from the Earth to be Apogee. The greatest attraction between Earth and Moon occurs at Perigree and, when this coincides with the time of the new or full Moon, the resulting spring tides are greater than average springs. Another example are the Equinoctial springs that occurs when the lunar and solar tide-generating forces are greater than average when the Moon and the Sun have low declination and vice versa. Near the equinoxes 21st of March and 23rd of September the Sun and the Moon when New and Full both have low declination. Therefore, at about these times of the year, greater than average spring tides can be expected. The greatest spring tides will occur after a New or Full Moon which is in Perigee near the Equinox. Meteorological conditions will cause differences between the predicted and the actual tides. The variations in tidal heights are caused mainly by strong or prolonged winds and by unusually high or low barometric pressures. Barometric pressure is important a difference from the average of 34 milibars can cause a difference in height of about one foot. A low barometer will raise sea level and a high barometer will lower it. These changes however seldom exceed one foot, but when mean sea-level is raised or lowered by strong winds or by storm surges, this effect can be important. The effect of wind on sea-level and therefore on tidal heights and times-is quite variable and depends largely upon the topography of the area in question. In general it is stated that wind will raise the sea-level in the direction toward which it is blowing. A strong wind blowing straight onshore will pile up the water and cause high waters to be higher than predicted, while winds blowing off the land will have the reverse effect. The duration of mean rise and fall of tides for any port or coastal areas are calculated empirically to give average conditions over a 19-year period in published tide tables. Apart from the meteorological influences mentioned above, tides are composed of both semidiurnal and diurnal components. River estuaries and narrow tide channels also effect tidal profiles. Even though tides can be of approximately 5 hour flood and approximately 7 hour ebb duration the average interval between successive high water and low water of semi-diurnal tides is is normally 6 hours and 13 minutes and between successive high waters 12 hours and 25 minutes. It is interesting to note that even if there is an earlier or later occurrence of high water on any day the pattern will always return to the average schedule over the full lunar cycle. Therefore from the foregoing description of tidal habits one must realize that despite all the scientific information aquired since the time of the ancient Greeks al tidal information is approximate, depending upon many variables, and a good safety margin must always be applied when using tidal information.

One object of the invention is to provide time tide devices having an AM PM disc that operates automatically on a watch or clock which may have any well known type of spring or electronic means.

Another object of the invention is to provide a power means of rotating a tide disc in the form of a bezel or a disc that would move in registration with a clock or watch face of 12 or 24 hour duration showing the state of the tide in conjunction with the time, moving in increments of approximately 50 minutes each day and specifically stopping and pointing a marker upon a watch face.

Another object of the invention is to provide a power means to rotate day, date, AM or PM readouts inside a watch or clock having a special gear arrangements to turn the information as needed to operate on this invention.

Another object of the invention is to provide a calendar disc having 14 days of tides showing marking every approximate 50 minutes and being interchangeable with other discs that can be placed upon a rotatable bezel having calendar dates upon it showing the tides from the first day to the last day of a month, upon a 12 hour clock or watch face, and rotated manually or automatically by power means.

Another object of the invention is to provide a comparative secondary tide disc or bezel to a watch or clock having and showing the specific time of the tides in other related areas of travel.

Another object of the invention is to provide a seasonal variable information disc that would be responsive to giving seasonal changes due to the difference in tides in different times of the year.

Another object of the invention is to provide manually operated discs with adjustable turning outside controls as shown in the drawings.

Another object of the invention is to provide the combination of time tide improvements that would operate on standard watches and clocks and also on electronic digital readout clocks wherein the placement of tide and calendar disc would transform any watch or clock into a tidal timepiece.

Another object of the invention is to provide a calendar disc having a full month of tidal information upon it showing markings approximately every 50 minutes, in days or date markings and for placement upon a 24 hour clockface presenting infinite information on tides when moved properly at the end of each calendar month, also pertaining to watches.

Still another object of the invention is to provide a time and tide device that may be used in different combinations of the art, in any other form that incorporates this invention whether placed upon standard or electronic watches, calculators and all kinds of clocks.

Other objects and advantages will be apparent from the following description, and it will be understood that changes in the specific structure shown and described may be made within the scope of the claims without departing from the spirit of the invention. Except for special gears arranged to turn the tide telling parts of the invention the other details of a clock movement are not a part of this invention and not in the claims, details of the clock movement are not referred to, except generally. Referring more particularly to the accompanying drawings in which corresponding parts are indicated by similar reference characters;

Figure 3:
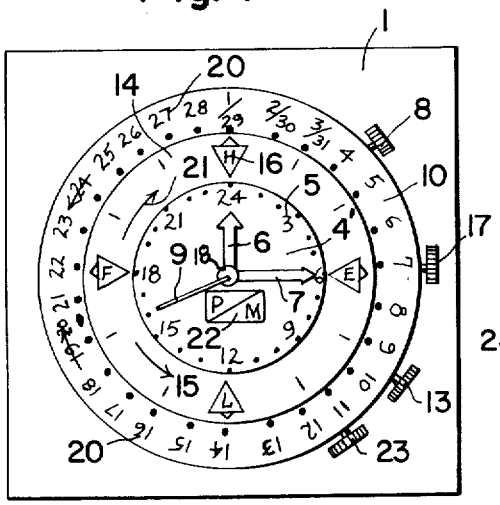

FIG. 3 also shows a frontal view of another time clock having the features of the invention.

Figure 4:
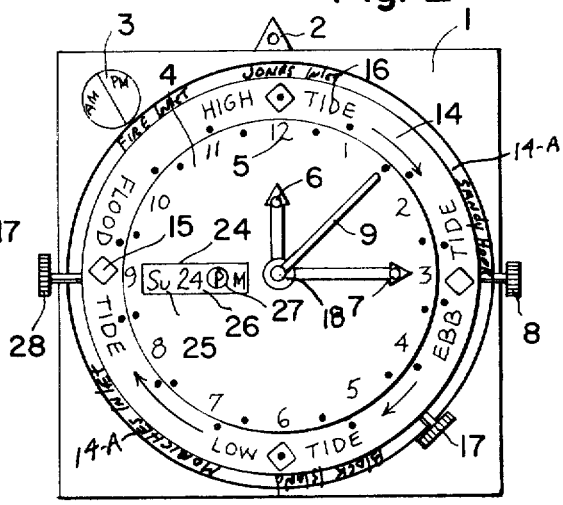

FIG. 4 shows a front plan view of a clock showing features of the invention.

Figure 5:
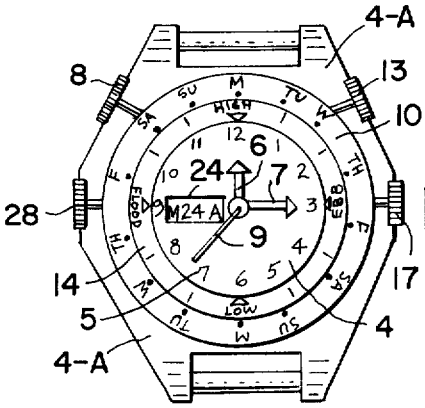

FIG. 5 shows a front plan view of a watch showing features of the invention.

Figure 6:
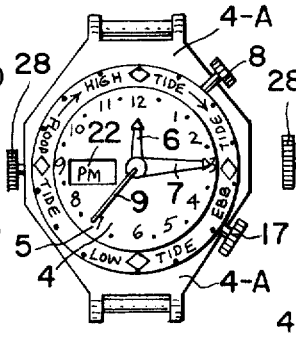

FIG. 6 is a front plan view of a watch also showing features of the invention.

Figure 7:
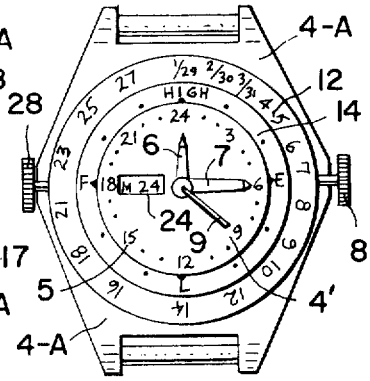

FIG. 7 is a front plan view of a watch also showing features of the invention.

Figure 8:
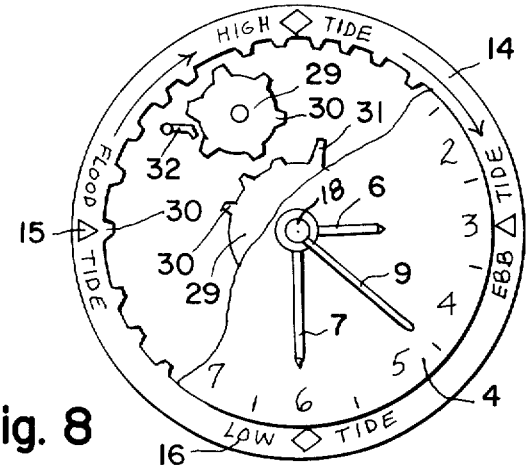

FIG. 8 shows a front cutout view of a tide clock or watch having a gear arrangement that turns the tide disc automatically.

Figure 9:
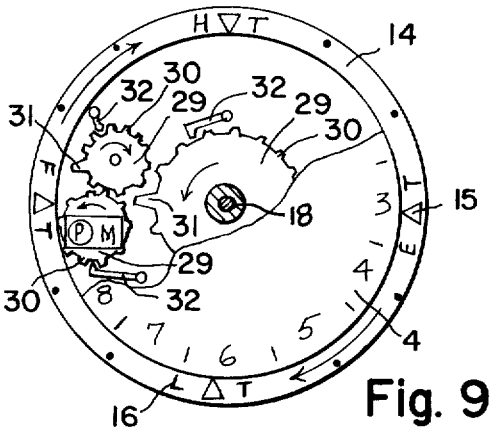

FIG. 9 shows a front cutout view of a tide clock or watch having a gear arrangement to turn the tide disc and the AM PM disc.

Figure 10:
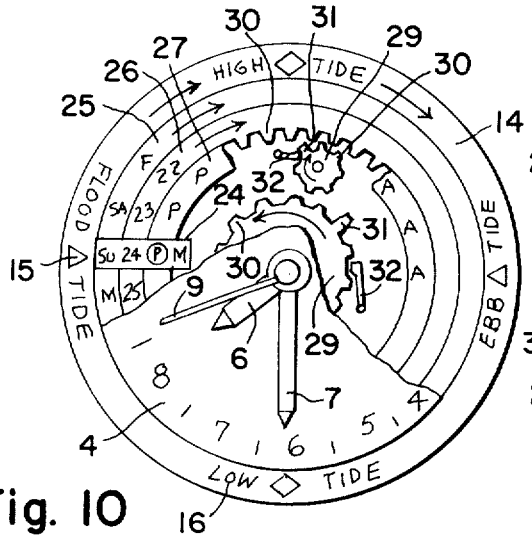

FIG. 10 shows a front plan cutout view of a tide clock or watch having a gear arrangement to turn the tide disc, the date, and the AM PM disc.

Figure 11:
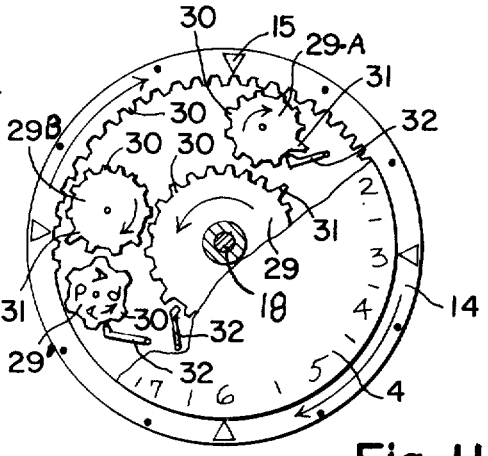

FIG. 11 shows a front plan view of a tide clock or watch also showing a gear arrangement to turn the tide disc and the AM PM disc.

Figure 12:
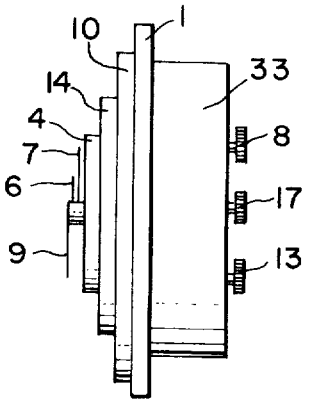

FIG. 12 shows a side view of an embodiment of the invention.

Figure 13:
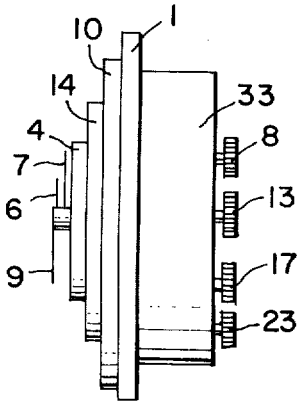

FIG. 13 shows a side view of FIG. 3 except that elements 8, 13, 17 and 23 extend radially in FIG. 3 and from the rear in FIG. 13.

Figure 14:
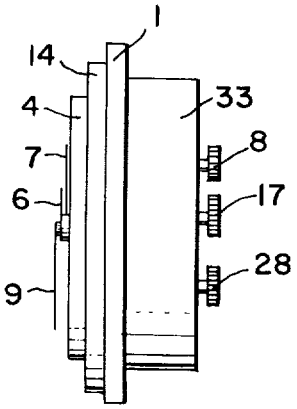

FIG. 14 shows a side view of an embodiment of the invention.

DESCRIPTION OF THE PREFERRED EMBODIMENTS.

Figure 1:
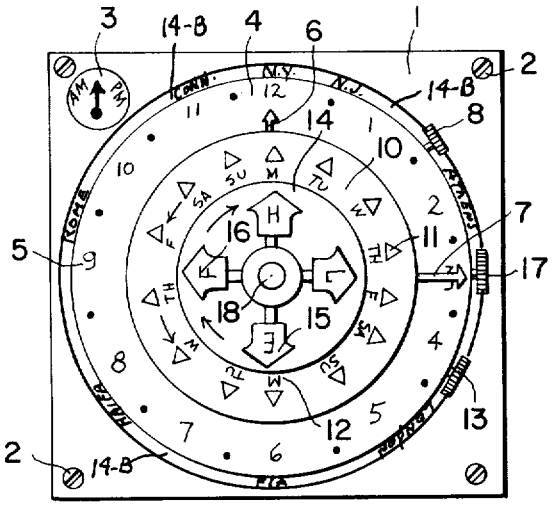
FIG. 1 shows a front plan view of a tide clock that incorporates features of this invention.

Referring to FIGS. 1–4 of the drawings, the tide time clock of the present invention is generally designated as 1. Clock 1 includes a standard clock movement motor 33 shown in side view FIGS. 12–14. The clock movement may be any well known type of clock movement which is either operated by a wound spring or electrically operated. The details of the clock movement 33 that normally operate the hour hand 6 and the minute hand 7 are not part of this invention, except where it is used to turn apparatus of this invention, are well known, and a detailed description of the clock movement will not be given. FIG. 1 shows a tide time clock 1 having a rotatable AM PM disc 3 moved by internal linkage connected to a clock works obvious to the invention but not shown in the drawing, also showing an outer peripheral disc 14B used as a comparative secondary tide disc 14-B that is rotatably affixed to the device for the purpose of supplying additional tide information in the surrounding geographical area that the device is used in. As an illustration let us assume that your home port is calculated on the time tide clock while the secondary tide disc shows all the tides of the important places in or around your area of travel, it would allow for tide changes instead of having to calculate them. A Captain of a ship would have information on tides even in different parts of the world on the secondary disc that is not restricted in size or having more than one disc. FIG. 1 also shows improvements by having clock hands adjustment means 8, calendar disc adjustment 13 and a tide disc adjustment 17 that allows each respective part to be adjusted and rotated. FIG. 1 also shows a 12 numeral clock face 4 having a shaft 18, a pair of arms 6 and 7 are mounted appropriately on the shaft 18 so as to rotate with the respective shaft and extend radially from the shaft actually having two shafts illustrated as one shaft 18 in the drawing. The arm 7 is longer than arm 6 so that the arm 7 is the minute indicating arm, and the arm 6 is the hour indicating arm. A face plate 4 is secured to the clock movement 33. FIGS. 1–7 all show the face plate 4 having indicia on its front surface to indicate the hours and minutes. As shown in FIG. 1 the clock plate 4 is a twelve hour clock in which the hour arm shaft 6 rotates at a speed of two revolutions per day (2 r.p.d.). However, as shown in FIGS. 3 and 7 the clock face 4 is a 24 hour clock in which the hour arm shaft rotates at a speed of one revolution per day (1 r.p.d.). The tide disc 14 and the calendar disc 10 are concentrically affixed to the end of shaft 18 locking the aforesaid parts to the clock shaft 18. The calendar disc 10 of FIG. 1 and the tide disc 14 can be rotated by the clock movement 33 moving the respective discs once or twice a day for a total of approximately 50 minutes a day.

Figure 2:
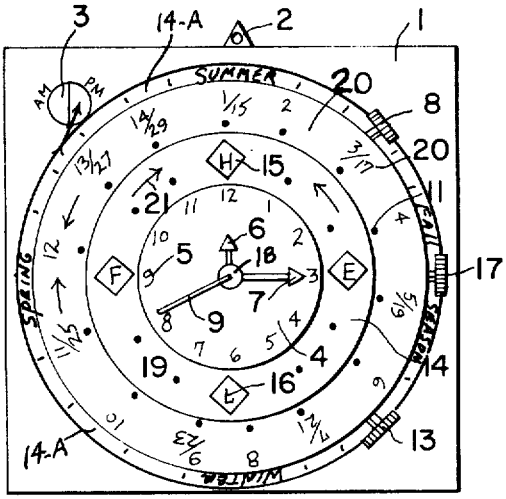
FIG. 2 shows a front plan view of another model timeclock having features of the invention.

FIG. 2 shows a time tide clock comparable to FIG. 1 except that the different features are considered unobvious and patently distinct. The calendar disc 20 shows a monthly illustration of calendar day dates which can be interchangeable with a preferred form of information easiest for the user. Another improvement is the seasonal tide variation disc that can be placed upon any of the illustrations shown in FIGS. 1–7. The same applies to the comparative secondary tide disc of FIG. 1 and furthermore both of these embodiments 14-A and 14-B can both be placed upon any clock or watch to give this necessary information. The seasonal tide variation disc 14-A and the secondary tide disc 14-B both operate manually as bezels on the periphery of a watch or clock turning both clockwise or counter-clockwise. The purpose of the variation disc 14-A is to place all the tidal seasons around a clock or watch so that at any time one can place the season in registration with the clock face 4, the calendar disc 10 or 20, the tide disc 14 and be able to add to the tidal calculation or subtract from the calculation a predetermined average known factor affecting the tides at that part of the season, fully discussed in the Background of the Invention. For example; if the tide and time device showed high tide on March 23 the seasonal tide variation disc 14-A will have already been calculated for this period when the greatest spring tides occur. The published 19 year tidal tables easily shown average conditions which can be preset upon this disc to give corrected tidal information. FIG. 2 shows manual and electric or wound means of turning the calendar disc 20 and the tide disc 14 which would be made with hourly graduations on the tide disc 14 showing the hours inbetween the tides. The clock hands adjustment 8, the calendar disc adjustment 13 and the tide disc adjustment 17 allow backward or forward movement of the respective discs.

FIG. 3 shows a 24 hour face plate 4' that allows the calendar disc to have twice the numerals around its periphery as illustrated giving a monthly account of tidal information at one time in registration with the clock face 4'. The tide disc 14 is positioned by the user in line with the day required and he can readily view the tide happenings. The movement of the respective discs is accomplished by the clock hand adjustment 8, the calendar disc adjustment 13, tide disc adjustment 17 and the AM PM indicator adjustment 23. A 24 hour face plate 4' has a total of 1440 minutes by multiplying 24 hours times 60 minutes each hour. Dividing this total by approximately 50 minutes (considered a Lunar day,) gives a total of 28.8 days that can be consecutively used on a watch or clock face having a 24 hour dial. Additional calendar dates follow as illustrated to make up the extra days to give a month of tidal information. Although there are places in the World that have only one tide instead of two highs and two lows each day it would be relatively easy to change the face of the tide disc 14 which is common to all the FIGS. 1–7 by showing just one tide per day. At most shores throughout the world there occurs two high and two low waters every lunar day, the average length of a lunar day being 24 hours and 50 minutes and 28 seconds. FIG. 3 further shows an improvement by having a cutout in the clock face 4' containing an AM PM indicator 22. The M in PM 22 stays constant while the A and the P in PM change according to the time. FIG. 11 explains the movement of this mechanism that accomplishes giving correct AM PM information, important in tidal watches and clocks.

FIG. 4 shows a time tide clock 1 of fairly simple design showing a 12 numeral clock face 4 having hourly and minute clock hands 6 and 9 respectively and a second hand 9. The tide disc 14 rotates in the direction of the arrow clockwise and therefore each day moves approximately 50 minutes by power means to the next corresponding position. In this manner we have a time tide clock arrangement that also shows the day and date and the AM or PM factors which all contribute to an efficient end product serving the safety of mankind. FIG. 4 also shows the comparative secondary tide disc 14-A on the outer periphery of the clock face 4. In the form of a bezel it would turn concentrically in either direction for placement of correct information as to the tides in various areas of your geographical surroundings. FIG. 10 of the drawings show details of FIG. 4 with exception of the tide variation disc 14-A.

The watches shown in FIGS. 5, 6 and 7 are much alike the combination of clocks already discussed in FIGS. 1–4. FIG. 5 resembles FIG. 1 except that the clock face 4 has been placed in its normal position in the center of the watch. The cutout has also been added having day date and AM PM information 24 placed in a watch base 4-A having a clock hand adjustment 8, calendar disc adjustment 13, tide disc adjustment 17 and the readout adjustment 28. This model illustrates a 12 hour clock face 4 which can be replaced by a 24 hour face 4' shown and explained in FIG. 3.

FIG. 6 resembles FIG. 4 with the only difference illustrated being the lesser information in the cutout that only shows the AM PM factor indicator 22. The tide disc 14 operates by the watch power.

FIG. 7 has a 24 hour clock face and the illustration shows; time; 15 minutes past 12 PM and over 20 seconds . . . high tide on the 29th day of the month (could be in the first of the month) and the corresponding days are all shown in their proper order. The two outer discs the tide disc 14 and the calendar disc 12 show two turning bezels each that are in registration with the clock face 4'.

FIG. 8 shows a cutout section of a time tide clock that largely resembles FIGS. 4 and 6. The gear 29 on a 12 hour face 4 would turn two revolutions each day and on a gear having 12 teeth the 12th tooth would engage the tide disc once every 12 hours and therefore move the tide disc to its proper indexed position. The detent 32 stabilizes the movement of gear 29 having engaging teeth 30.

FIG. 9 shows a rotatable tide disc 14 powered by motor means 33 having a driving gear 29 turning counter-clockwise having one larger gear tooth 31 than its ordinary sized gears 30 having a detent 32 to keep the gear in position when not being turned. The gear 29 would turn once daily on a 24 hour clock or watch an twice on a 12 hours model. In turning, the gear tooth 31 makes contact with another gear that rotates clockwise also having one larger gear 31 that engages the tide disc gear 30 (not shown in this illustration). In turn the second gear moves the third gear, a AM PM indicator. You will note that the AM PM indicator 22 rotates counterclockwise and has one stationary figure marked M while the prefix A and P move on a disc attached the said gear. The AM PM information should change every 12 hours because in this invention we utilize the clockface and a 12 hour clock face must have 12 hours of AM and then 12 hours of PM. Therefore, the AM PM gear must have at least 48 teeth to accomplish this so that when the tide disc moves twice a day in 12 days it would have turned the AM PM gear to its next proper position. On a 24 hour face clock it would require half the gear teeth because the tide disc would move only once a day instead of twice.

FIG. 10 is alike FIG. 4 but having no comparative secondary tide disc 14-B considered optional. The clock motor gear 29 has one large protruding gear tooth 31 upon it that engages and turns the discs, which are in registration and held together, at one time. You will note that the AM PM information disc 27 only shows a A and P and has a sufficient number of characters to constantly show the correct AM and PM. This illustration applies to clocks and watches and the same is true of the other Figures.

FIG. 11 shows an arrangement of three gears wherein the drive gear 29 is connected to the power shaft 18 having gear teeth 30, a detent 32 and a protruding gear tooth 31 that makes contact with at least one other gear shown as 29-A which turns the tide bezel disc 14 a total of 50 minutes a day which on a 12 hour clock face 4 accommodating in this invention the following mathematical conclusion for both the 12 and 24 hour clock face when it is converted to tidal use;

EXAMPLE A;

12 hour clock face times 60 minutes per hour = 720 min. 720 min ÷ by each approx. lunar day 50 min. = 14.4 days the degrees of tide movement equals 25° per day (360° divided by 14.4 equals 25° )

EXAMPLE B;

24 hour clock face times 60 min. per hr. equals; 1440 min. 1440 min. ÷ by a lunar day approx. 50 min. = 28.8 days the degrees of tide disc movement equals 12½ deg. per day (360 deg. divided by 28.8 days equals 12½° )

These devices for time and tide calculators watches and clocks feature many improvements to the art that utilize the clock faces on all watches and clocks in the manner described offering simplicity and utility in conjunction with becoming an important safety device. It is useful as calculators moved manually, as watches and clocks that have spring wound or electronic means of power to operate it. It offers a new comparative secondary tide disc that will render immediate area tide readings for comparison purposes and a new seasonal variation disc that will assist the user in making seasonal tidal allowances in given areas according to published tidal tables which are calculated empirically over a 19 year period showing average conditions. These conditions would be reduced to plus and minus factors to be applied to the time indicated by the time and tide devices of this invention. The basic transformation of the clock face to a tidal hour readout accomplishes a new art over former art devices that are more complicated, more costly to produce and therefore limiting its success. The purpose of this invention is to provide simple devices that fit on or attach to a standard watch or clock that in some instances requires no more than turning bezels to produce a time tide device. Furthermore, if the calender disc of FIG. 5 is used and the clock face were divided into 14 equal days it would present a device having infinite time tide readings wherein the calculation would be; (12 hour clock or watch) 720 minutes divided by 14 days equals a total of 51.428571 minutes per day. When considering all the variables one could live with the slight departure from the 50 minutes and 28 seconds of change each lunar day. On a 12 hour watch face there is in this calculation an adjustment that can be made each 14 days that amounts to 20 minutes or one-third of an hour or two-thirds of an hour each 28 days and thereby providing a time tide device that operates infinitely by succeeding weeks of every month on a perpetual basis. On the watch in FIG. 7 the 24 hour watch face converts into at least 28.8 lunar days making it extremely easy to place the additional calendar days on the calender disc 4' thereby also providing a monthly control of time and tides accurately indexed and in registration with the clock face discussed. The AM PM factor is very important to time tide determinations particularly where the tide reaches a high point twice in every 24 hours; and the second high point is chronologically later than the first high point to a degree which can be substantially represented by a definite time period, that is, if the tide is high at 5 oclock AM, it will be high again at approximately 5;25 PM. This variance may be greater or smaller, but may be readily approximated for most localities. In view of this relation I have provided this device with AM and PM information that would operate in the following manner in conjunction with the object of this invention to employ the use of the clock face;

example; the AM PM information disc will only have to turn the A or P to give this information and each day the disc would advance two positions for example until the number of positions equalled a total of 12 hours. Two positions per day would require a 24 tooth gear arrangement and after reaching this point the cycle is repeated on the other part of the disc for the next 12 hours so that continuous AM and PM readings are available at the proper time of occurrence having intrinsic value to the devices it is place upon.

This continuation in part application places motorized means to the calculator parts of the original invention Ser. or No. 243,001 by motorizing the various members of the device, showing interchangeable calendar disc bezel information and a number of other improvements discussed in the specification, shown in the drawings and claimed.

While I have described my invention in detail for the preferred forms shown, it will be understood that modifications may be made within the scope of the invention as defined in the appended claims.

I claim:

1. A tide time indicating device of the character described showing the precalculable relationship between tide, time, date and place comprising a base having a clock face disc with hour and minute numerals thereon, hands for hour, minute and seconds displaying time at every moment connected to a motor drive means therefore a clock motor driver tide disc comprising marks corresponding to different tide phases and being set apart from each other through distances which correspond on said clock face disc to the times elapsing between said time phases, and a clock motor driver calendar disc comprising a predetermined sequence of regularly staggered marks at approximately 50 minutes apart corresponding to successive days, the space between two consecutive marks of said calendar disc at least corresponding on said time disc to the mean interval between the times when the same tide phase occurs at the same place on two consecutive days, a comparative rotatable secondary tide disc comprising marks corresponding to different earth places, the distance between any two ones of these marks corresponding on the time scale to the time interval between the times at which the same tide phases occur at the earth places to which said pair of marks correspond, each of said discs the clock face dics, tide disc, calendar disc and comparative secondary tide disc are coaxially mounted upon said base, also having an AM PM disc rotatably affixed upon said base turned by said drive means and all of the said discs being rotatably associated with said base each having setting crowns mounted upon said base for manual adjustment of said discs.

2. A tide time indicating device in accordance with claim 1, wherein the specific markings of said discs extend upon concentric circular zones.

3. A tide time indicating device in accordance with claim 2 wherein the markings of said clock-face are provided on a fixed dial plate and the markings of said calendar and tide and secondary tide disc are mounted for rotary movement around said fixed dial plate.

4. A tide time indicating device in accordance with claim 1, wherein the said comparative secondary tide disc is rotated manually by hand turning means.

5. A tide time indicating device in accordance with claim 1, wherein said discs are mounted on watches and clocks on concentric rotatable rings placed inside and outside of said clock-face on said base.

6. A tide time indicating device as in claim 1, wherein said tide disc rotates approximately 50 minutes each day in registration with said clock-face marked with said tide change markings.

* * * * *